US008051499B2

(12) United States Patent
Lee

(10) Patent No.: US 8,051,499 B2
(45) Date of Patent: Nov. 8, 2011

(54) SAFETY HELMET VISOR SETTING MECHANISM

(75) Inventor: Te Lung Lee, Yung Kang (TW)

(73) Assignee: Long Huei Helmet Co., Yung Kang (TW)

( * ) Notice: Subject to any disclaimer, the term of this patent is extended or adjusted under 35 U.S.C. 154(b) by 478 days.

(21) Appl. No.: 12/199,837

(22) Filed: Aug. 28, 2008

(65) Prior Publication Data

US 2010/0050326 A1 Mar. 4, 2010

(51) Int. Cl.

| | |
|---|---|
| ***A42B 1/08*** | (2006.01) |
| ***A42B 1/06*** | (2006.01) |
| ***A63B 71/10*** | (2006.01) |
| ***A61F 9/00*** | (2006.01) |

(52) U.S. Cl. ..... 2/424; 2/410; 2/425; 2/10

(58) Field of Classification Search ..... 2/410, 6.1, 2/6.2, 6.3, 6.4, 6.5, 6.6, 6.7, 6.8, 421, 422, 2/423, 424, 425, 10, 9, 171, 209.12, 209.13; D29/102, 103, 104, 105, 106, 107, 108, 109, D29/110

See application file for complete search history.

(56) References Cited

U.S. PATENT DOCUMENTS

| | | | | |
|---|---|---|---|---|
| 4,297,747 | A * | 11/1981 | Nava | 2/424 |
| 5,329,642 | A * | 7/1994 | Dampney | 2/424 |
| 6,851,129 | B2 * | 2/2005 | Gafforio et al. | 2/424 |
| 2006/0117467 | A1 * | 6/2006 | Choi et al. | 2/424 |
| 2006/0230507 | A1 * | 10/2006 | Yeh | 2/410 |
| 2007/0074335 | A1 * | 4/2007 | Gafforio et al. | 2/410 |
| 2008/0216215 | A1 * | 9/2008 | Lee | 2/424 |

* cited by examiner

*Primary Examiner* — Gary L Welch
*Assistant Examiner* — Jane Yoon
(74) *Attorney, Agent, or Firm* — Alan Kamrath; Kamrath & Associates PA

(57) ABSTRACT

A safety helmet visor setting mechanism includes a shell having an indent at each side and a long opening behind the indent at one side. An anchored unit fits in the long opening and has two grooves. A hold plate has two push chunks placed in the two grooves respectively. A link bar, fixed in the anchored unit and jostled with the hold plate, can be moved by the drive of the push chunk. A cover, capping the anchored unit, jostles with the link bar and the hold plate for a lockup. A first visor joint, positioned inside the shell in one side, has a bottom end pinned joined with the top end of the link bar, and has a top end provided with a cave. A second visor joint, positioned inside the shell in the other side has a springy slice forming an accommodation space with the shell. A visor has a clasp slice at each side penetrating the caves and the accommodation spaces of both the first visor joint and the second visor joint for assembly.

10 Claims, 6 Drawing Sheets

(C-C)

(B-B)

(A-A)

SAFETY HELMET VISOR SETTING MECHANISM

BACKGROUND OF THE INVENTION

1. Field of the Invention

The present invention relates to safety helmet visor setting mechanisms and, more particularly, to one that features easy lifting of the visor and handy assembly or disassembly.

2. Description of the Prior Art

The general safety helmet protective lens is categorized as a windshield visor fixed outside the shell, and a sunshade visor fixed inside the shell. The latter is installed inside the shell and located between the shell and the Styrofoam inner helmet. Once the visor is damaged and in need for a replacement, the helmet liner fixed in the inner helmet is unloaded, the inner helmet is discharged, and then, the visor is ready for removal for replacement. The reloading is accomplished by reversing the whole procedure, which is troublesome. Moreover, the installation of the helmet liner involves specialized skills and practice. The appropriateness of the installation affects considerably the fit and comfort of the head of the user, which may substantially distract the user, and it absolutely calls for great improvement.

SUMMARY OF THE INVENTION

The main object of the present invention is to provide a safety helmet visor setting mechanism which allows easy lifting of the visor.

Another object of the present invention is to provide a safety helmet visor setting mechanism which is handy for assembly or disassembly of the visor and which proves to have greatly improved the drawbacks of the prior art.

To accomplish the foregoing objects, the present invention comprises: a shell having an indent at each side and a long opening behind the indent at one side. An anchored unit, designed to fit in the long opening of the shell, has two grooves. A hold plate, fixed in the anchored unit, has two push chunks placed in the two grooves respectively. A link bar, having its bottom end fixed in the anchored unit and jostled with the hold plate, can be moved by driving the push chunk. A cover, capping the anchored unit, jostles with the link bar and the hold plate for a lockup. A first visor joint, positioned inside the shell in one side, has a bottom end in a pinned joint with the top end of the link bar and has a top end provided with a cave. A second visor joint, positioned inside the shell in the other side, has a springy slice, which forms an accommodation space with the shell. A visor has a clasp slice at each side. The clasp slices the caves and the accommodation spaces of both the first visor joint and the second visor joint for accomplishing assembly. By pressing the push chunk of the hold plate and by lifting or lowering the link bar for an angle, which simultaneously drives the first visor joint for the angle, the visor is then pulled in place or pushed upward.

For the other object, the present invention comprises: a first visor joint, positioned inside the shell in one side, having a bottom end in a pinned joint with the top end of the link bar and having a top end provided with a cave. A second visor joint, positioned inside the shell in the other side, has a springy slice, to form an accommodation space with the shell. A visor has a clasp slice at each side. The clasp slices penetrate the caves and the accommodation spaces of both the first visor joint and the second visor joint for accomplishing assembly and accomplishing prompt loading and unloading of the visor.

DETAILED DESCRIPTION OF THE INVENTION

To achieve the foregoing objects of the present invention, the techniques adopted and the achievable function are detailed and described with reference to the following preferred exemplified embodiment and the accompanying drawings, which is expected to help in comprehending the contents of the present invention thoroughly.

Figure 5:
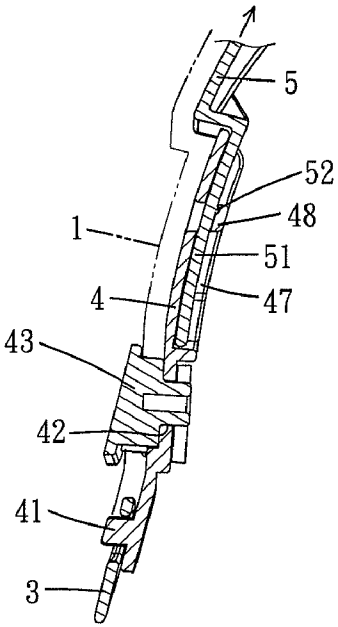
FIG. 5 is a sectional diagram viewing from C-C in FIG. 2.
Figure 4:
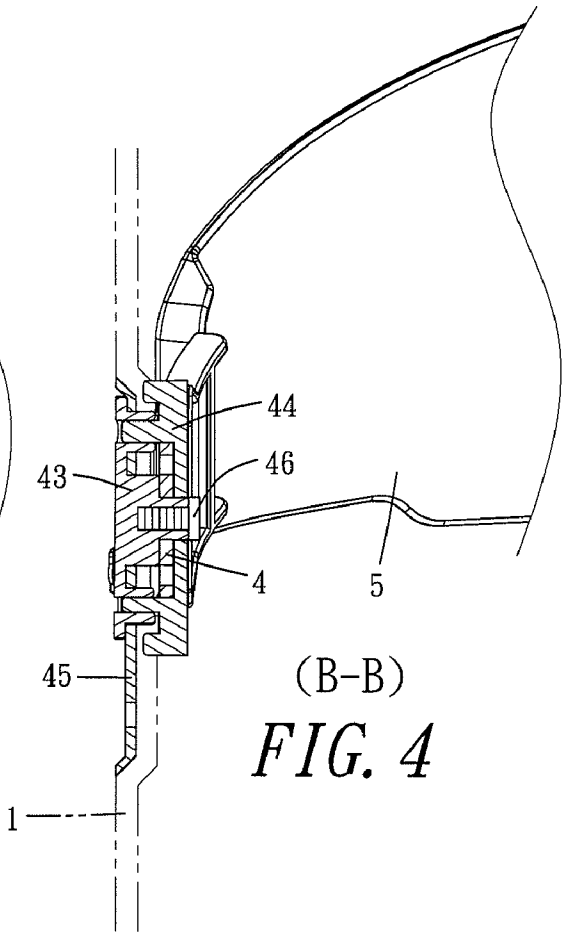
FIG. 4 is a sectional diagram viewing from B-B in FIG. 2.

Referring to FIGS. 1-5, the present invention comprises a shell 1 having an indent 11 at each of both sides. The indent 11 is provided with the necessary and adequate number of through holes and screw holes. In the right side, the indent 11 is provided with a long opening 12. An anchored unit 2 is placed in the long opening 12 of the shell 1 and jostled with the shell 1. The anchored unit 2 within the shell 1 is made up of a rod 21 located in the middle, two grooves 22 & 23 located in the opposite sides of the rod 21 respectively, and two gaps 24 & 25 located in the same side of the corresponding grooves 22 & 23 respectively. A hold plate 20, fixed to the anchored unit 2, has a push chunk 26 & 27 at each side, and the push chunks 26 & 27 are placed in the two grooves 22 & 23 respectively. The push chunks 26 & 27 have a hook 28 & 29 respectively at one end that are seized in the gaps 24 & 25. A link bar 3 has a long trough 31 at its top end, while its bottom end is lodged in the anchored unit 2 and jostled with the hold plate 20, and while its two side bottoms each has a prop chunk 32 & 33 located at the top of corresponding push chunks 26 & 27, which are connected to the hooks 28 & 29 respectively. A cover 30, capping and fastened to the anchored unit 2 by a screw 34, can simultaneously jostle with the link bar 3 and the hold plate 20 for a lockup. A first visor joint 4, positioned inside the shell 1, has a plug slice 41 at its bottom inside, which is pinned joined with the long trough 31 on the top of the link bar 3. The first visor joint 4 has a hole 42 at its middle to cap the shaft cover 43. Through fastening by a push cover 44 and a screw 46, the visor joint 4 is being placed in position, and the visor joint 4 and the link bar 3 are able to rotate an angle around an axis defined by a protruded shaft of the shaft cover 43 which penetrates the shell 1 from outside. The push cover 44 lays on the top of the visor joint 4, holds the shaft cover 43, and fastens with the shaft cover 43 by the penetration of the screw 46. The push cover 44, has a guide pole 45 in each side. The first visor joint 4 has a cave 47 at its top inside, and the cave 47 has a bar 48 inside and at its top to form an entrance of the cave 47. The first visor joint 4 has one arced spring sliding track 49 at each side of its middle portion, for the sliding movement of the guide pole 45. The track 49, also, acts as the limiter for the rotational movement of the first visor joint 4, that is, the limiter for the lifting and lowering of a visor 5. The visor 5, referring to FIG. 6, in the shape of an arced hollow, has a clasp slice 51 at its right end, and the clasp slice 51 has a protruded bar 52 at its outer side. Once the clasp slice 51 is inserted into the cave 47 of the joint and the protruded bar 52 is set to jostle against the inner side of the bar 48, the right side of the visor 5 and the first visor joint 4 are joined together as shown in FIG. 5. The a left side of the visor 5 is provided with a clasp slice 53, and the clasp slice 53 has a curved or an arc bulge 54 at its outer side.

Figure 6:
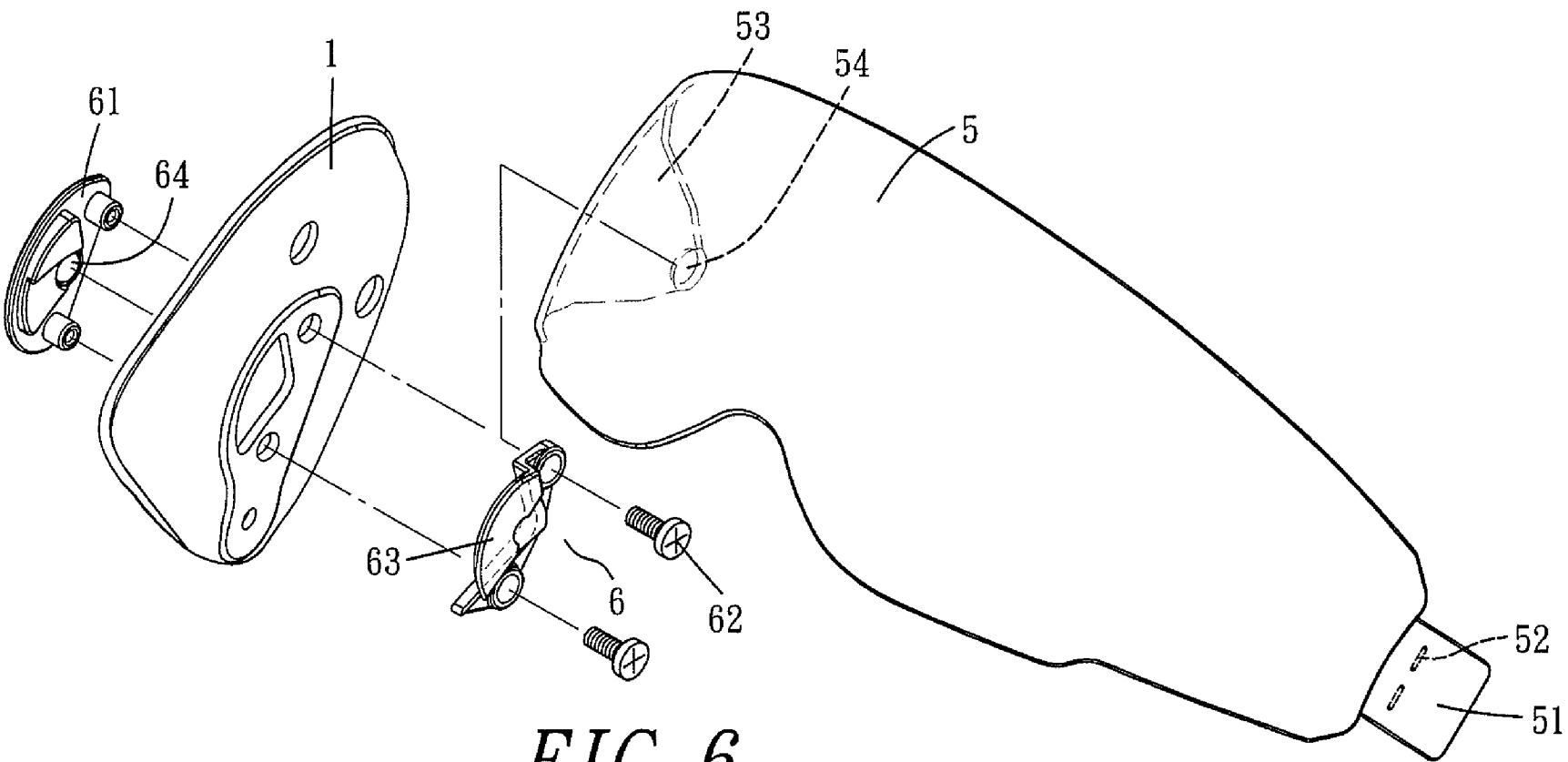
FIG. 6 is a three-dimensional exploded view of the left side portion and the visor of the present invention.
Figure 7:
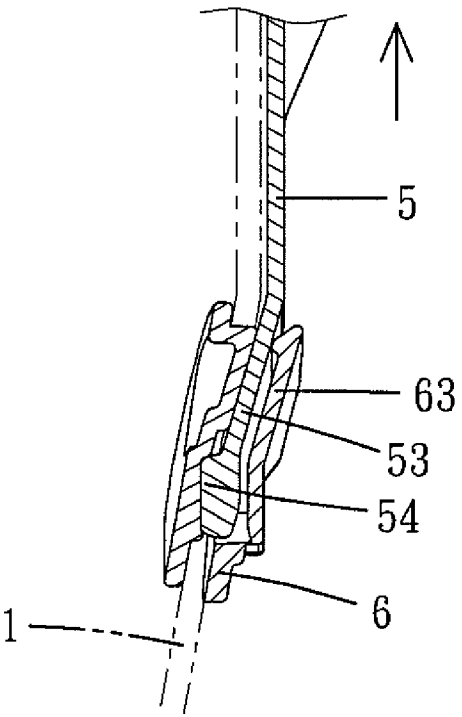
FIG. 7 is an assembled exploded view of the left side portion and the visor of the present invention.

A second visor joint 6, positioned inside the shell 1 at the left side, referring to FIGS. 6 & 7, and fastened by a mount cover 61 and a screw 62, has a springy slice 63. A distance between the springy slice 63 and the shell 1 forms an accommodation space, and the mount cover 61 is located in the accommodation space and is provided with a cave 64. Once the clasp slice 53 is inserted into the accommodation space and the bulge 54 is lodged in the cave 64, the left side of the visor 5 and the second visor joint 6 are joined together.

Figure 1:
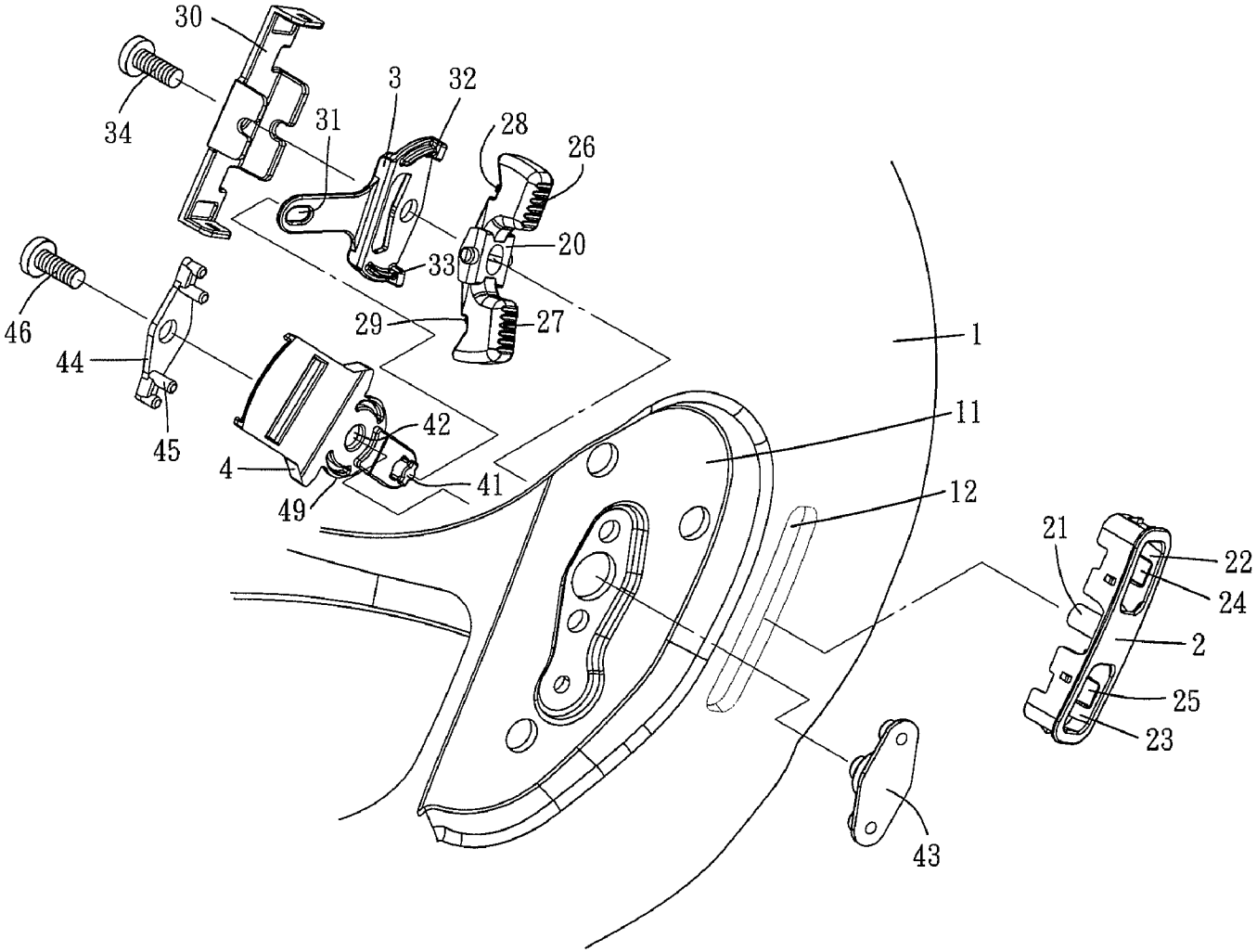
FIG. 1 is a three-dimensional exploded view of the right side portion of the present invention.
Figure 2:
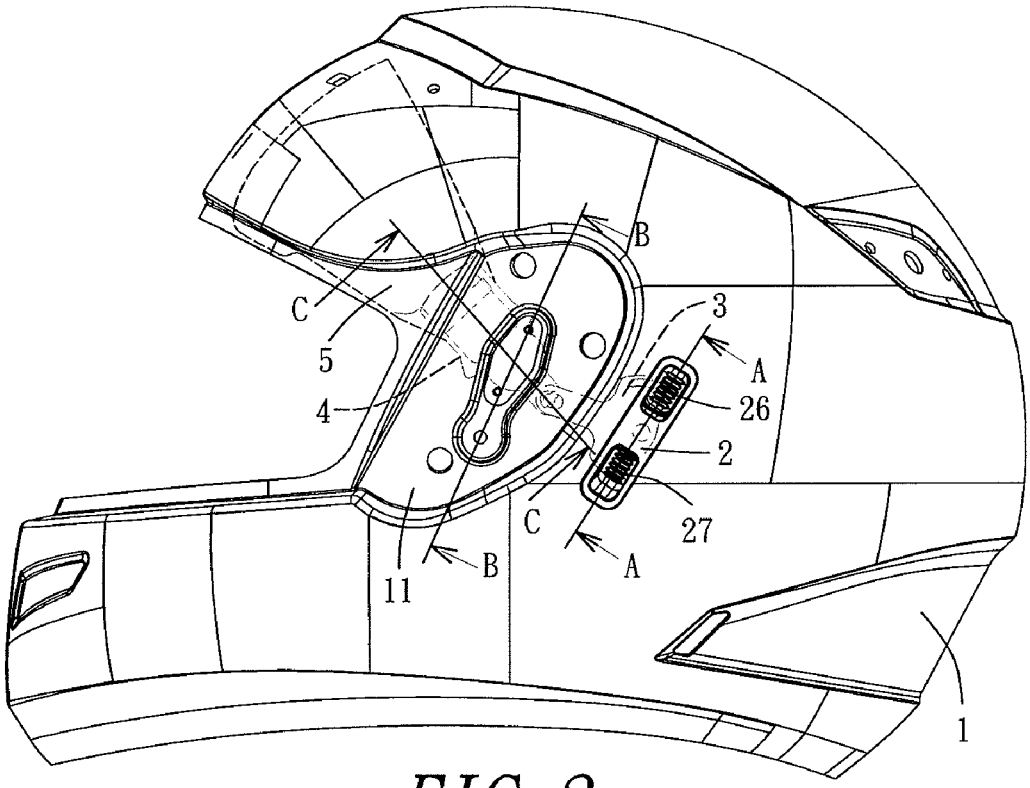
FIG. 2 is a schematic side view of the right side portion of the present invention.
Figure 8:
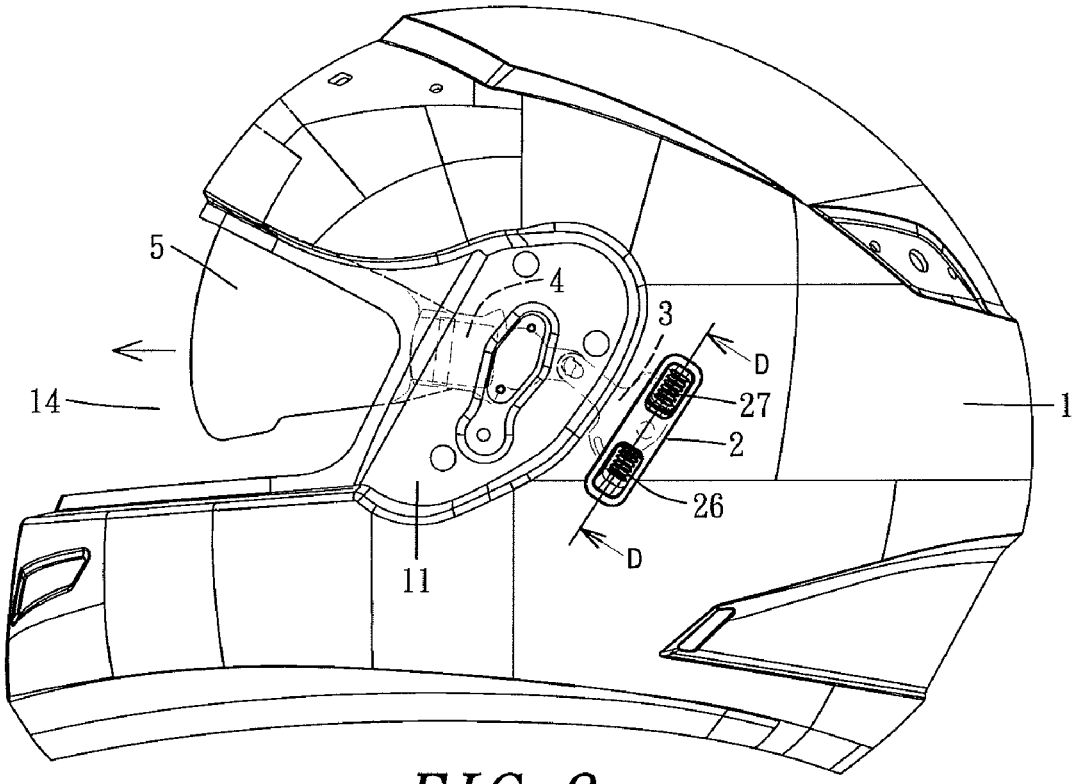
FIG. 8 is a schematic side view of the status of the use of the visor of the present invention.
Figure 3:
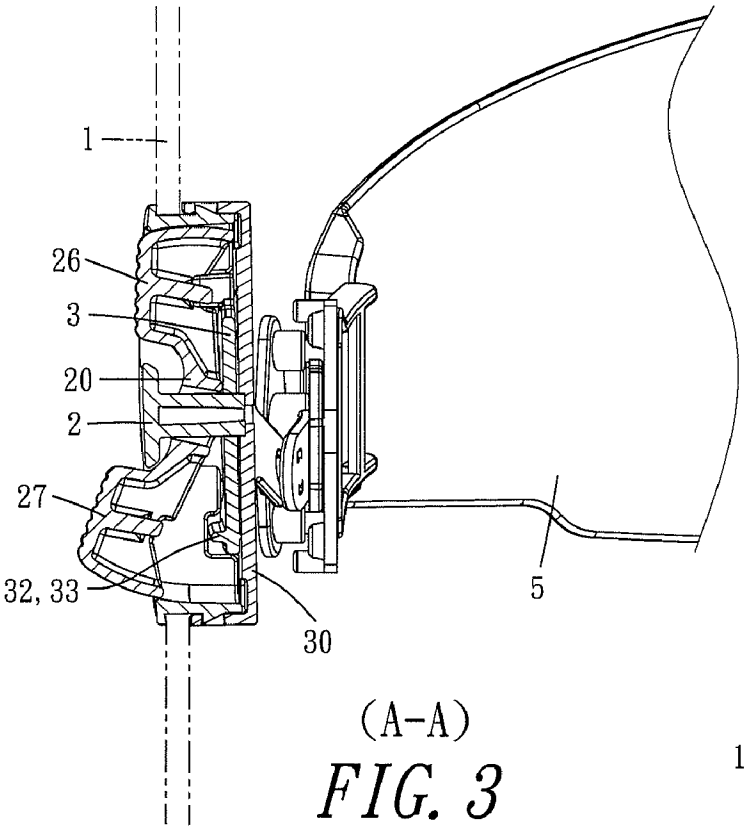
FIG. 3 is a sectional diagram viewing from A-A in FIG. 2.
Figure 9:
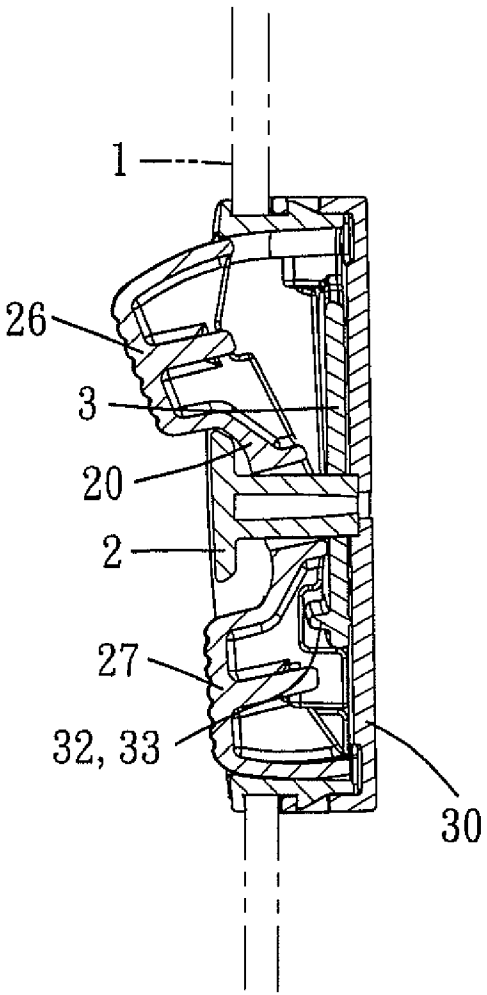
FIG. 9 is a sectional diagram viewing from D-D in FIG. 8.
Figure 10:
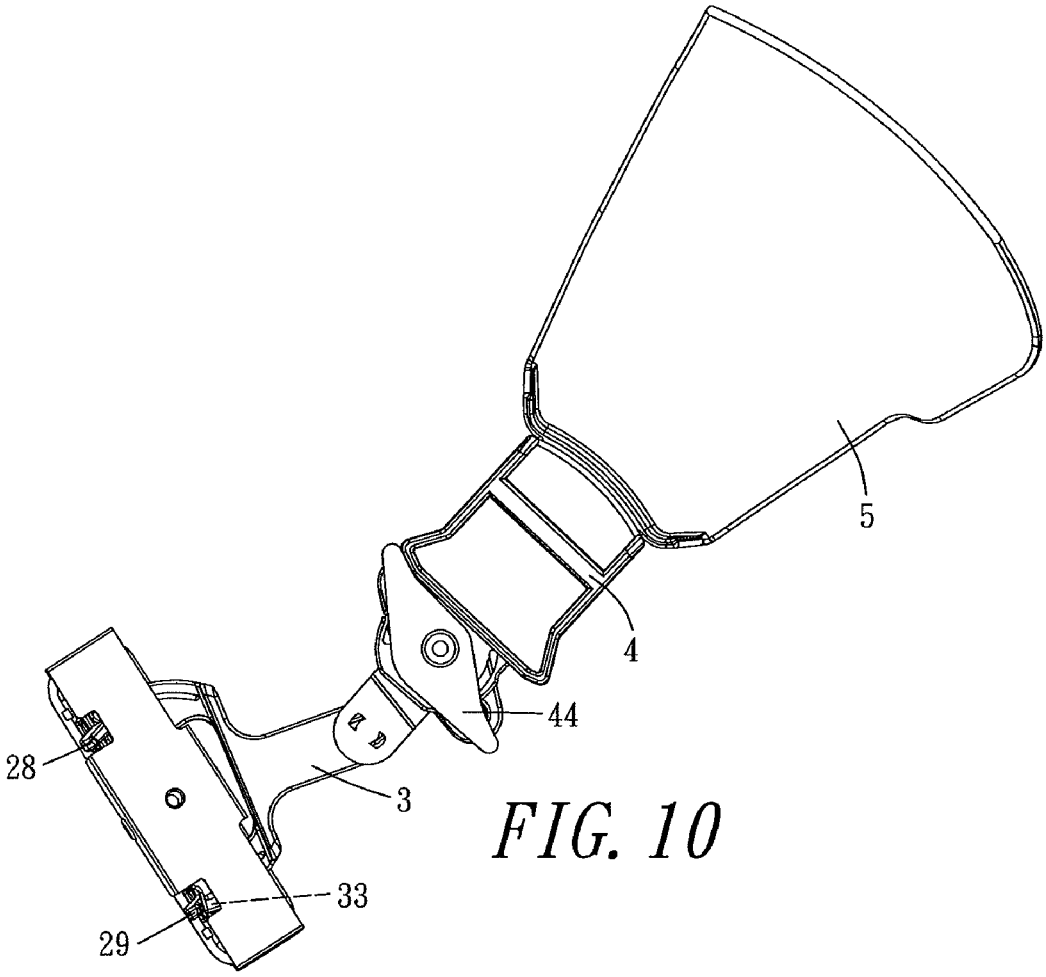
FIG. 10 is a schematic side view of the lifting of the visor of the present invention.
Figure 11:
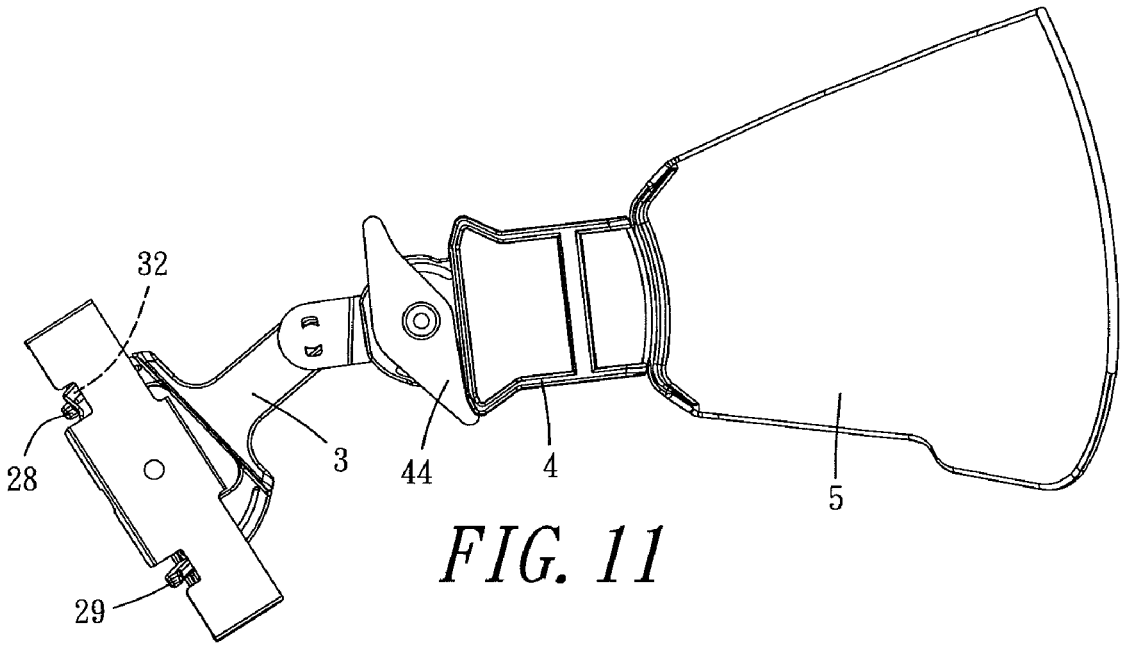
FIG. 11 is a schematic side view of the lowering of the visor of the present invention.

According to the aforementioned structural combination, the visor 5 has both ends joined to the first and the second visor joints 4 & 6, shown in FIGS. 5 & 7. When not in use, the visor 5 is lifted above and hid in the shell 1, as shown in FIG. 2. At this moment, the first visor joint 4 is up-lifted, the push chunk 26 on the top end of the hold plate 20 is pressed to immerge in the groove 22 of the anchored unit 2, the hook 28 is located below the prop chunk 32, the push chunk 27 on the bottom end of the hold plate 20 stands convexly in the groove 23 of the anchored unit 2, and the hook 29 is located above the prop chunk 33, as shown in FIGS. 3 & 10. On the contrary, if the push chunk 27 is pressed (or if the visor 5 is pulled down directly), the hook 29 pushes the prop chunk 33 to simultaneously drive the link bar 3 for swinging upward an angle, and the link bar 3 drives the first visor joint 4 to swing downward an angle with the shaft cover acting as the axis, so that the visor 5 is driven to move downward and located at the window 14 in the front of the shell 1, for the use of sunshade, as shown in FIG. 8. At this moment, the first visor joint 4 appears to be slightly horizontal, the push chunk 27 at the bottom of the hold plate 20 was pressed to immerge in the groove 23 of the anchored unit 2, the hook 29 is located below the prop chunk 33, the push chunk 26 on the top end of the hold plate 20 stands convexly in the groove 22 of the anchored unit 2, and the hook 28 is located above the prop chunk 32, shown in FIGS. 9 & 11.

For lifting or lowering of the visor 5 described in the aforesaid, the first visor joint 4 has its hole 42 encircle the shaft cover 43 and takes the protruded shaft of the shaft cover 43 as the axis for the rotation, while the second visor joint 6 rotates with respect to the axle made by the bulge 54 and the cave 64.

To strip the visor 5, the procedure starts by lowering the visor 5 down first, shown in FIG. 8, followed by holding the middle portion of the visor 5 by hand. A slight pull outward is enough to dismount the clasp slice 51 at the right side of the visor 5 from the cave 47 of the first visor joint 4 and to dismount the clasp slice 53 in the left side of the visor 5 from the accommodation space between the second visor joint 6 and the shell 1, according to the arrow heads shown in FIGS. 5, 7 & 8. Assembly demands, firstly, inserting the clasp slice 53 of the visor 5 in its left side into the accommodation space between the second visor joint 6 and the shell 1, and lodging the bulge 54 into the cave 64 shown in FIG. 7. Then, the clasp slice 51 in the right side of the visor 5 is inserted into the cave 47 of the first visor joint 4, and the protruded bar 52 is jostled against the inner side of the bar 48, as shown in FIG. 5. Assembly of the visor 5 is then accomplished, and it is ready for lifting or lowering the visor 5, as shown in FIGS. 2 & 8.

From the description in the above, the present invention features at least the following advantages and functions, which is extremely creative over the prior art.

1. The assembly or disassembly of the visor 5 is not only easy and prompt, but free of stripping or installing the helmet liner and without need of any tools.

2. The lifting or lowering of the visor 5 is not only easy and prompt but economical of effort.

It's worth to lay particular stress on the traits and spirit of the design of the helmet visor setting mechanism of the present invention. Aside from the inclusion of the fixed setting comprising: the anchored unit 2, the hold plate 20, the link bar 3, the first visor joint 4 and the second visor joint 6, the present invention also comprises an assembled structure that is made up of the clasp slices 51 & 53 in both sides of the visor 5 and the first and the second visor joints 4 & 6. Therefore, any variations of equivalent structure that make use of the techniques and design spirit of the present invention come within the range of the claims of the present invention.

To sum up, the disclosed concrete structure of the exemplified embodiment of the present invention is not only unknown to the prior art, but surely can accomplish the expected objective and function, which is construed as absolutely novel and having creativeness.

What is claimed is:

1. A safety helmet visor setting mechanism, comprising:

a.) a shell having an indent at each of two sides, wherein one side of the shell is provided with a long opening behind the indent;

b.) an anchored unit located in the long opening of said shell and having two grooves;

c.) a hold plate fixed in said anchored unit and having two push chunks placed in the two grooves respectively;

d.) a link bar having a bottom end fixed in said anchored unit and jostled with said hold plate, with the link bar moved by driving the push chunk;

e.) a cover capping said anchored unit and jostling with said link bar and hold plate for a lockup;

f.) a first visor joint positioned inside said shell in one side and having a bottom end in a pinned joint with a top end of said link bar;

g.) a second visor joint positioned inside said shell in the other side; and h.) a visor having a clasp slice at each of two sides, wherein the clasp slice at each of the two sides penetrates said first visor joint and second visor joint, respectively, for accomplishing assembly;

wherein pressing the push chunk of said hold plate and moving of said link bar for an angle, simultaneously drives said first visor joint for the angle, allowing said visor then to be pulled in place or pushed upward.

2. A safety helmet visor setting mechanism as in claim 1 wherein said anchored unit is provided with a rod at its middle portion for the fastening with said hold plate, link bar and cover.

3. A safety helmet visor setting mechanism as in claim 1 wherein each push chunk of said hold plate is provided with a hook, with said link bar being provided with a corresponding prop chunk.

4. A safety helmet visor setting mechanism as in claim 1 wherein said link bar is provided with a long trough at the top end, and said first visor joint being provided with a corresponding plug slice at the bottom end.

5. A safety helmet visor setting mechanism as in claim 1 wherein said first visor joint is provided with a hole at a middle portion encircling a shaft of a shaft cover extending through a push cover.

6. A safety helmet visor setting mechanism as in claim 1 wherein said first visor joint is provided with a cave, and the cave being provided with a bar, to form an entrance of the cave.

7. A safety helmet visor setting mechanism as in claim 1 wherein said second visor joint is provided with a springy slice which forms an accommodation space between said second visor joint and said shell.

8. A safety helmet visor setting mechanism as in claim 7 wherein the accommodation space between said second visor joint and said shell is provided with a cave.

9. A safety helmet visor setting mechanism as in claim 1 wherein the clasp slice at one end of said visor is provided with a protruded bar.

10. A safety helmet visor setting mechanism as in claim 9 wherein the clasp slice at the other end of said visor is provided with a bulge.

* * * * *